US005890447A

United States Patent [19]

Bernson

[11] Patent Number: 5,890,447

[45] Date of Patent: Apr. 6, 1999

[54] FURLING DEVICE FOR A SAILING BOAT

[76] Inventor: Christer Bernson, Hinsholmsgatan 12, S-426 77 Västra Frölunda, Sweden

[21] Appl. No.: 981,656

[22] PCT Filed: Jun. 20, 1996

[86] PCT No.: PCT/SE96/00818

§ 371 Date: Dec. 27, 1997

§ 102(e) Date: Dec. 27, 1997

[87] PCT Pub. No.: WO97/00811

PCT Pub. Date: Jan. 9, 1997

[30] Foreign Application Priority Data

Jun. 20, 1995 [SE] Sweden ..... 9502236

[51] Int. Cl.[6] ..... B63H 9/04

[52] U.S. Cl. ..... 114/106; 114/107

[58] Field of Search ..... 114/39.1, 104–107

[56] References Cited

U.S. PATENT DOCUMENTS 5,632,215 5/1997 Moessnang et al. ..... 114/106

*Primary Examiner*—Ed L. Swinehart
*Attorney, Agent, or Firm*—Dvorak & Orum

[57] ABSTRACT

An arrangement for a sailing boat which exhibits a jib furling system (2) comprising a sail furling part (5) extending between the hull and mast of the boat, which sail furling part is rotatably driven by means of a manually actuated operating line (6) which drives a drive part (7) that is connected to the aforementioned sail furling part (5) to achieve furling of the foresail around the aforementioned rotatable sail furling part (5), and so that unfurling of the sail from the aforementioned sail furling part (5) is possible. A gear (9) is arranged between the aforementioned drive part (7) and the rotatable sail furling part (5). The gear (9) is provided with devices to enable gearing to be obtained between the aforementioned drive part (7) and the rotatable sail furling part (5).

9 Claims, 2 Drawing Sheets

FURLING DEVICE FOR A SAILING BOAT

BACKGROUND OF THE INVENTION

1. Field of the Invention

The present invention relates to an arrangement for a sailing boat which exhibits a jib furling system comprising a sail furling part extending between the hull and mast of the boat, which sail furling part is rotatably driven by means of a manually actuated operating line which drives a drive part that is connected to the aforementioned sail furling part to achieve furling of the foresail around the aforementioned rotatable sail furling part, and so that unfurling of the sail from the aforementioned sail furling part is possible, in conjunction with which a planetary gear is arranged between the aforementioned drive part and the rotatable sail furling part, which planetary gear is provided with devices to permit gearing to be achieved between the aforementioned drive part and the rotatable sail furling part.

2. Description of the Prior Art

Jib furling gear on boats is already known from the middle of the 1970s. In view of the constant increase in the size of boats, there is an increasing need to be able to handle the large foresails and similar sails which they carry, and which it is wished to furl onto and unfurl manually from the associated sail furling part, in spite of the fact that increasingly great force is required for this purpose.

An attempt has been made to solve the aforementioned problem of the force required by increasing the width of the winding drum. This has resulted in a restriction in the space available on deck, however, which is not advantageous given the wish to retain the largest possible free space on deck at the bows in order, amongst other things, not to obstruct free passage to and from the boat.

The jib furling drive arrangement previously disclosed in DE 3001527 A1 comprises a planetary gear. A planetary gear accommodated internally in a drive part executed as a line pulley is supported mounted on a radially extending disc-shaped flange, which is securely attached to a sleeve capable of rotating externally about a stay. The previously disclosed arrangement is complicated, however, and does not permit simple assembly and dismantling of the constituent parts. A clamping arrangement for stays or wires is also difficult to accommodate internally within the arrangement.

The principal object of the present invention is, therefore, in the first instance, to make available an arrangement of the aforementioned kind with which it is possible to solve the aforementioned problems simply and effectively.

SUMMARY OF THE INVENTION

The aforementioned objective is achieved by means of an arrangement in accordance with the present invention, which is characterized essentially in that an axially extending sleeve is arranged internally within the aforementioned arrangement and gear in such a way as to form a central shaft for the planetary carrier, in that the aforementioned central shaft is non-rotatably attached to the hull of the boat via the lower part of a lower end closure, in that the aforementioned central shaft functions as an attachment for the intended bearings which interact with the planetary carrier, sun wheel and drive part for the planetary gear, in that a sail attachment hook is rotatably mounted on the planet carrier on the upper part of the arrangement, and in that an anchoring part forms an attachment for a tensioned wire extending internally within a channel in the sail furling part accommodated between the hull and the mast.

BRIEF DESCRIPTION OF THE DRAWINGS

The invention is described below as a preferred illustrative embodiment, in conjunction with which reference is made to the accompanying drawings, in which.

DETAILED DESCRIPTION OF THE PREFERRED EMBODIMENT

Figure 1:
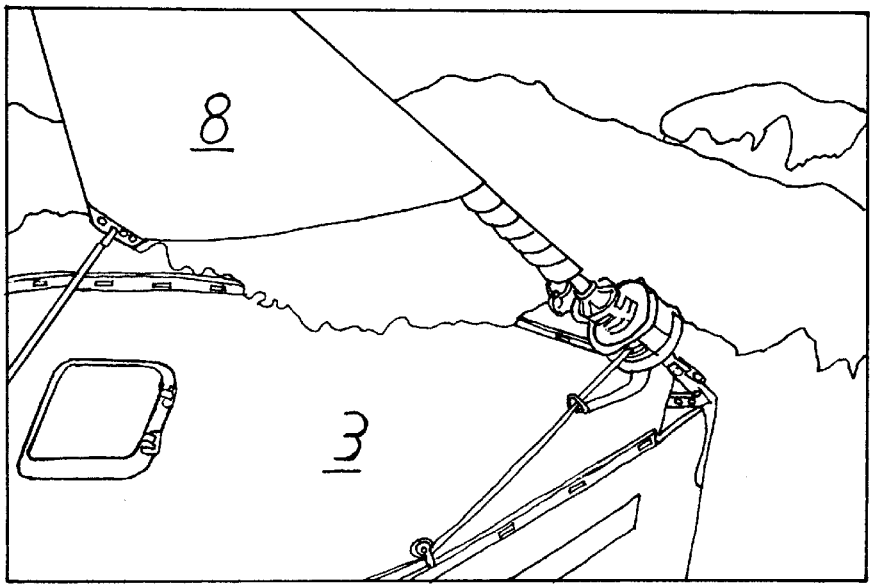
FIG. 1 shows a previously disclosed jib furling system installed on a boat and in use.
Figure 2:
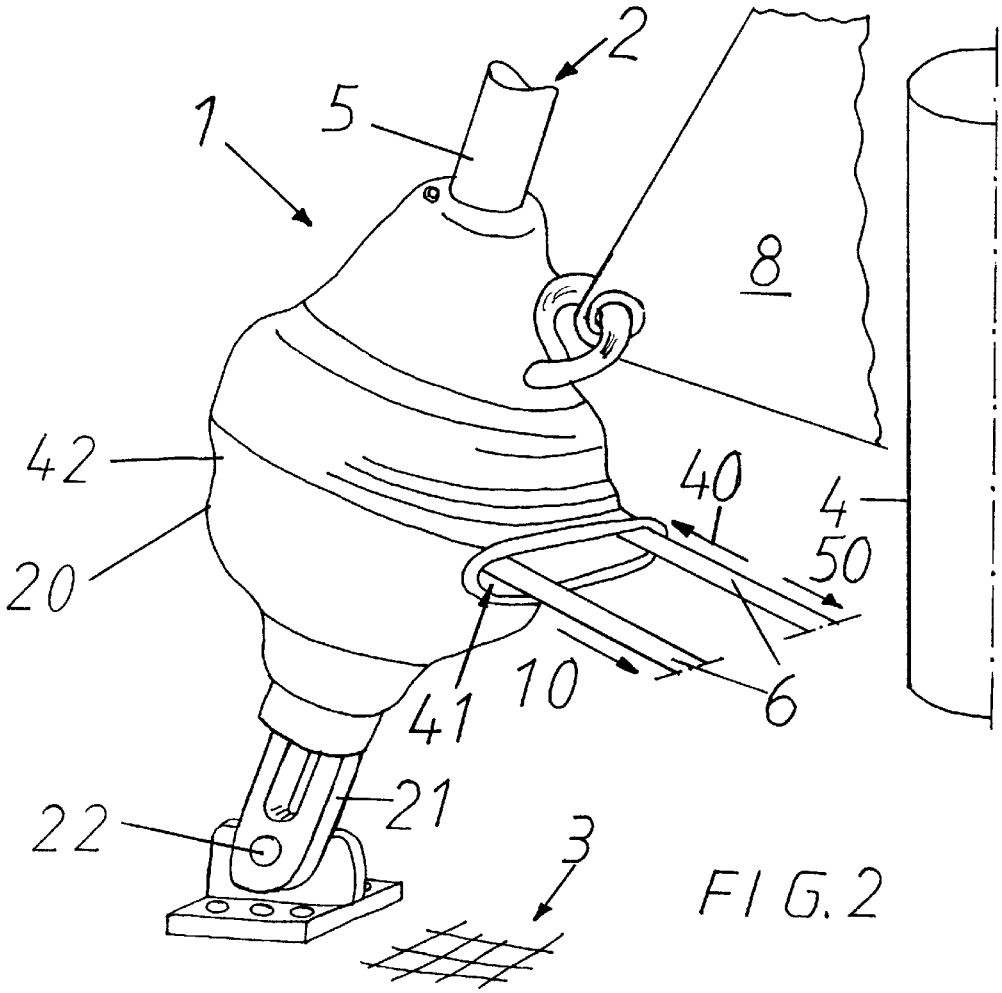
FIG. 2 shows a perspective view of an arrangement for a novel jib furling system.
Figure 3:
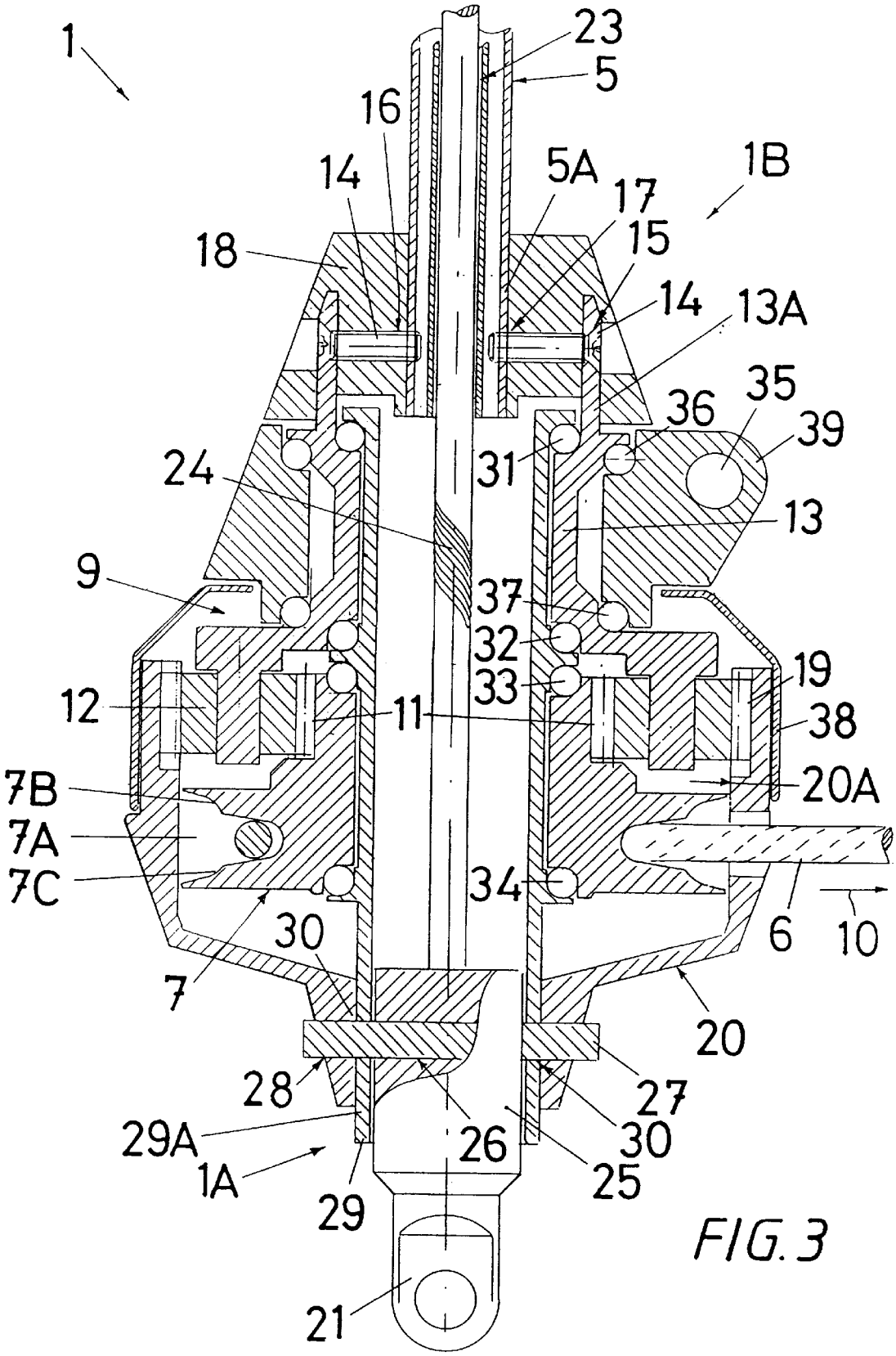
FIG. 3 shows a sectional view of the aforementioned arrangement.

An arrangement 1 in accordance with the present invention, which is intended to be used in a sailing boat which exhibits a jib furling system 2 comprising a sail furling part 5 extending between the hull 3 and the mast 4 of the boat, which part is rotatably driven by means of an operating line 6 capable of manual operation which, in its effective driving position, drives a drive part 7 which is attached to the aforementioned sail furling part 5 in order to achieve furling of the foresail 8 around the aforementioned rotatable sail furling part 5, and which permits unfurling of the sail 8 from the aforementioned sail furling part 5, exhibits means for achieving gearing. More specifically, a gear 9 is arranged between the aforementioned drive part 7 and the aforementioned rotatable sail furling part 5. This gear is provided with devices for permitting suitable gearing to be obtained between the aforementioned drive part 7 and the aforementioned rotatable sail furling part 5.

The aforementioned gear consists more specifically of a planetary gear 9.

In accordance with one preferred illustrative embodiment, a drive part 7 executed as a line pulley or a line drum is connected to the aforementioned planetary gear 9 in order, in the driving position, to drive the gear 9 when an outgoing end of the operating line 6 is pulled manually in the direction 10 of extension.

The sun wheel 11 of the planetary gear is preferably connected to the aforementioned drive part 7 in order for it to rotate as a common rigid unit in the same direction when the drive part 7 is caused by the line 6 to rotate in the desired direction of furling or unfurling. At the same time, the planet wheels 12 of the gear, which may be of a desired number and may have an appropriate number of teeth, are connected to the rotatable sail furling part 5, for example via a sleeve-shaped planet carrier 13, which at its upper end 13A is non-rotatably attached to the lower end 5A of the sail furling part. The rotatable sail furling part is preferably formed from a profile rail of a previously disclosed kind, to which the sail is attached by its inner edge. Screws 14, which are accommodated in matching holes 15, 16, 17 situated in the planet carrier 13, in an upper end closure 18 and in the sail furling part 5, hold the planet carrier 13 and the sail furling part 5 together in a non-rotatable fashion.

In the preferred illustrative embodiment of the invention shown here, a ring wheel 19 is alternately connected to the hull 3 of the boat via the bottom end of a lower end connection 20 for the arrangement 1.

The arrangement is attached via a so-called fork toggle 21 or other suitable anchoring part, which is situated at the lower part 1A of the aforementioned arrangement, to the hull 3 of the vessel on the deck at the bows in a previously disclosed fashion by means of a secured bolt, etc. 22. The aforementioned anchoring part 21 also provides an attachment for a tensioned wire 24 extending internally within a channel 23 accommodated in the sail furling part 5 between the hull 3 and the mast 4.

The attachment of the aforementioned wire 24 to the anchoring part 21 is effected by means of a thickened end part 25 through which there extends a hole 26 for accommodating a shaft 27. The aforementioned transcurrent shaft 27 is so arranged as to be accommodated in holes 28 which extend cross-wise through the aforementioned lower end connection 20, on the inside 20A of which the ring wheel 19 of the gear is arranged. The ring wheel 19 is prevented from rotating in this way and is retained in a non-rotating position so that the gear 9 functions in accordance with the calculations.

A sleeve 29 extending axially internally within the aforementioned arrangement 1 and gear 9 is so arranged as to form a central shaft for the planet carrier 13.

The aforementioned central shaft 29 is non-rotatably attached to the anchoring part 21 by means of the aforementioned transverse shaft 27, which is accommodated in matching holes 30 across the central shaft 29 at its lower part 29A.

The aforementioned central shaft 29 also acts as an attachment for the intended bearings 31–34 which interact with the planet carrier 13, the sun wheel and the drive part 7.

A sail attachment hook 35 is arranged on a rotating part which is rotatably mounted, for example on the sleeve-shaped planet carrier 13, via bearings 36–37 on the upper part 1B of the arrangement. A suitable clamping arrangement for the aforementioned stay or wire can be accommodated internally within the sleeve 19.

In order to achieve complete sealing of the internal space of the gear, a cover 38 is accommodated between the aforementioned ring wheel 19 and the rotating part 39 for the aforementioned sail attachment hook 35.

An ingoing part and an outgoing part of an operating line 6 preferably executed as a closed loop, which only runs around the drive part, or which runs around it in a number of turns respectively towards 40 and away from 10 the drive part 7, is so arranged as to run through a matching opening 41 in a protective casing 42 which forms part of the aforementioned lower gear end closure 20. The operating lines 6 are then accommodated by double blocks as they run along the same side of the boat back towards the cockpit, from where the sail is regulated by pulling on the desired operating line 6 for unfurling and furling the foresail 8 to the desired degree. Further lines are attached to the sail 8 in a previously disclosed fashion.

A form of planetary gear is selected in this case so that the desired gearing is obtained with the appropriate gear reduction, so that the force required to pull on the line 6 is not too great, but without having to draw more line by hand than the amount by which the sail 8 is caused to turn by the aforementioned sail furling parts 5.

The function of the invention should have been appreciated from the foregoing and the illustrations in the drawings, although a brief explanation of the design shown in the drawings is required.

By pulling on the line 6 in the direction 10 of extension, the line 6 interacts with the line pulley 7 and is drawn into a line groove 7A arranged therein and radially inwards in a direction towards grooves arranged on the internal grooved walls 7B, 7C of the pulley. As the pulley, etc., 7 is rotated, for example in the direction of unfurling of the sail, the sun wheel 11 in this case is caused to rotate in the same direction as the pulley 7. The sun wheel 11 interacts in this case with planet wheels 12 distributed around it, which planet wheels are supported by the planet carrier 13, and is caused to rotate and turn against the non-rotatably mounted ring wheel 19 (also referred to as the outer sun wheel) which is attached to the hull 3 of the boat via the anchoring part 21. The construction and function of the planetary gear thus mean that the planet wheels 12 cause associated attached planet carriers 13 and an end closure 18 to rotate together with the associated sail furling part 5, so that the sail 8, when the draw line 6 is pulled in the direction 10 of extension, can be unfurled and tensioned with a further line attached thereto, but not shown here, which is also operated from the cockpit of the boat. The sail 8 is unfurled to the desired degree in this way.

When the draw line 6 is pulled out in the direction 50 of extension, the sail 8 is furled once more onto the sail furling part 5 that functions as a winding roller, since the gear functions in the manner described above, although in the opposite direction of movement.

The invention is not restricted to the illustrative example described above and illustrated in the drawings, but may be varied within the scope of the Patent Claims without departing from the idea of invention.

I claim:

1. A furling device having an upper part and a lower part for a foresail of a sailboat having a mast, a hull and a tensioned wire attached to the mast, the furling device comprising:

(a) a sail furling part which extends between the hull and the mast for receiving the foresail;

(b) a manually actuated operating line for driving the drive part into rotation;

(c) a planetary gear, arranged between the furling part and the drive part for coupling the furling part to the rotatable drive part;

(d) an axially extending sleeve arranged internally within the planetary gear to form a central shaft for the planetary gear;

(e) a lower end closure comprising a lower part connected to the sleeve;

(f) a first set of bearings attached to the sleeve and coupled to the planetary gear;

(g) a second set of bearings attached to the sleeve and coupled to the drive part;

(i) a sail attachment hook rotatably mounted on the planetary gear;

(j) a channel extending within the sail furling part for receiving the tensioned wire; and (k) an anchoring part coupled to the lower part of the device for attaching the tensioned wire to the furling device.

2. The device of claim 1, wherein the planetary gear includes a planet carrier connected to the sail furling part.

3. The device of claim 2, wherein the planetary gear includes a sun wheel connected to the drive part.

4. The device of claim 3, wherein the planetary gear includes a planet wheel connecting the sun wheel to the planet carrier.

5. The device of claim 4, wherein the planetary gear includes a ring wheel connected to the hull.

6. The device of claim 5, further including a cover arranged between the ring wheel and the sail attachment hook for sealing the planetary gear.

7. The device of claim 5, wherein the lower end closure includes an inside portion within which the ring wheel is arranged.

8. The device of claim 1, further comprising a protecting casing enclosing the drive part, said casing having an opening therein for receiving the operating line.

9. The device of claim 1, further comprising a thickened end part for attaching the tensioned wire to the anchoring part, said thickened end part having a hole extending therethrough, said lower end closure having further holes extending cross-wise therethrough, said hole and further holes being provided for accommodating a shaft.

* * * * *